US007773056B2

(12) United States Patent
Kwak et al.

(10) Patent No.: US 7,773,056 B2
(45) Date of Patent: Aug. 10, 2010

(54) PIXEL CIRCUIT AND LIGHT EMITTING DISPLAY

(75) Inventors: Won Kyu Kwak, Seongnam (KR); Sung Cheon Park, Suwon (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 823 days.

(21) Appl. No.: 11/274,941

(22) Filed: Nov. 14, 2005

(65) Prior Publication Data

US 2006/0114193 A1 Jun. 1, 2006

(30) Foreign Application Priority Data

Nov. 22, 2004 (KR) ..... 10-2004-0095984

(51) Int. Cl.
*G09G 3/20* (2006.01)

(52) U.S. Cl. ..... 345/76; 345/77; 345/78; 345/79; 345/80; 345/81; 345/82; 345/83; 315/169.3

(58) Field of Classification Search ..... 345/76–83; 315/169.3
See application file for complete search history.

(56) References Cited

U.S. PATENT DOCUMENTS 6,229,506 B1 * 5/2001 Dawson et al. ..... 345/82
6,421,033 B1 * 7/2002 Williams et al. ..... 345/55
6,618,031 B1 * 9/2003 Bohn et al. ..... 345/83
6,937,215 B2 * 8/2005 Lo ..... 345/82
6,975,290 B2 * 12/2005 Asano ..... 345/76
2004/0183758 A1 * 9/2004 Chen et al. ..... 345/76
2004/0217694 A1 * 11/2004 Cok et al. ..... 313/504
2005/0052365 A1 3/2005 Jang
2006/0077134 A1 * 4/2006 Hector et al. ..... 345/76

FOREIGN PATENT DOCUMENTS

JP 2002-215096 7/2002

* cited by examiner

*Primary Examiner*—Alexander Eisen
*Assistant Examiner*—Stuart McCommas
(74) *Attorney, Agent, or Firm*—Christie, Parker & Hale, LLP

(57) ABSTRACT

A pixel circuit for a light emitting display. Adjacent pixels of the light emitting display coupled to one scan line share one first power supply line. A driving circuit in each pixel circuit drives first and second organic light emitting diodes (OLEDs). A switching circuit is coupled between the first and second OLEDs and the driving circuit to sequentially control the driving of the first and second OLEDs. Because two adjacent pixel circuits share one pixel power supply line and a plurality of OLEDs are coupled to one pixel circuit, it is possible to reduce the number of pixel circuits and the number of wiring lines of the light emitting display. Other circuit elements may also be shared between adjacent pixel circuits. Reducing the wiring and other elements of the pixel circuits makes it possible to increase the aperture ratio of the light emitting display.

16 Claims, 6 Drawing Sheets

PIXEL CIRCUIT AND LIGHT EMITTING DISPLAY

CROSS-REFERENCE TO RELATED APPLICATION

This application claims priority to and the benefit of Korean Patent Application No. 10-2004-95984, filed on Nov. 22, 2004, in the Korean Intellectual Property Office, the entire content of which is incorporated herein by reference.

BACKGROUND

1. Field of the Invention

The present invention relates to a light emitting display, and more particularly to a pixel circuit coupled to a plurality of organic light emitting diodes (OLED) that emit light so that it is possible to improve the aperture ratio of the light emitting display, to compensate for the threshold voltage, and to thus make brightness uniform and a light emitting display using the same.

2. Discussion of Related Art

Recently, various flat panel displays of lower weight and volume compared with cathode ray tubes (CRT) have been developed. In particular, light emitting displays having improved luminous efficiency, brightness, view angle, and high response speed are spotlighted.

In an OLED, an emission layer made of a thin film that emits light is positioned between a cathode electrode and an anode electrode. Electrons and holes are injected into the emission layer and are recombined to generate exciters at a reduced overall energy. Light is emitted as a result of this recombination.

The emission layer of the OLED may be formed from organic or inorganic material. The OLED is divided into organic and inorganic OLEDs according to the type of the emission layer.

FIG. 1 is a circuit diagram illustrating a part of a conventional light emitting display. Four adjacent pixels are shown that each include an OLED and a pixel circuit. The pixel circuit includes a first transistor T1, a second transistor T2, a third transistor T3, and a capacitor Cst. Each of the first, second, and third transistors T1, T2, T3 includes a gate, a source, and a drain and the capacitor Cst includes a first electrode and a second electrode.

Because the pixels all have the same circuit, only the left top pixel will be described. The source of the first transistor T1 is coupled to a power supply line Vdd, the drain of the first transistor T1 is coupled to the source of the third transistor T3, and the gate of the first transistor T1 is coupled to a first node A. The first node A is coupled to the drain of the second transistor T2. The source of the second transistor T2 is coupled to a data line D1, the drain of the second transistor T2 is coupled to the first node A, and the gate of the second transistor T2 is coupled to a first scan line S1. The second transistor T2 transmits a data signal to the first node A in response to the scan signal applied to its gate. The first transistor T1 supplies current corresponding to the data signal to the OLED.

The source of the third transistor T3 is coupled to the drain of the first transistor T1, the drain of the third transistor T3 is coupled to the anode electrode of the OLED, and the gate of the third transistor T3 is coupled to an emission control line E1 to respond to an emission control signal. Therefore, the third transistor T3 controls the flow of current that flows from the first transistor T1 to the OLED in response to the emission control signal to control emission of the OLED.

The first electrode of the capacitor Cst is coupled to the power supply line Vdd and the second electrode of the capacitor Cst is coupled to the first node A. The capacitor Cst is charged according to the data signal and applies a signal to the gate of the first transistor T1 during one frame and therefore maintains the first transistor T1 operating during the one frame.

However, in the conventional pixel circuit for the light emitting display, because each OLED is driven by a pixel circuit of its own, a plurality of pixel circuits are necessary to drive a plurality of OLEDs. This design feature increases the number of pixel circuits that form the display.

Also, because one emission control line and a pixel power supply line are coupled to each pixel row, wiring lines become complicated and the aperture ratio of the light emitting display deteriorates.

Therefore, there is a need for an alternative design that reduces the number of the pixel circuits and simplifies the arrangement of the wiring lines.

SUMMARY OF THE INVENTION

Accordingly, one aspect of the present invention provides light emitting displays, in which two adjacent pixel circuits coupled to one scan line share one pixel power supply line and a plurality of OLEDs are coupled to one pixel circuit so that it is possible to reduce the number of pixel circuits and the number of wiring lines of the light emitting display and thus improve the aperture ratio of the light emitting display.

The foregoing and/or other aspects of the present invention are achieved by providing a light emitting display including an image display unit coupled to a plurality of scan lines, a plurality of data lines, a plurality of emission control lines, and a plurality of first power supply lines and including a plurality of pixels formed in the regions defined by the scan lines and the data lines. Each of first and second adjacent pixels coupled to one scan line and one first power supply line among the plurality of pixels includes first and second OLEDs, a driving circuit commonly coupled to the first and second OLEDs to drive the first and second OLEDs, and a switching circuit coupled between the first and second OLEDs and the driving circuit to sequentially control the driving of the first and second OLEDs. The driving circuit includes a first transistor for receiving the first power source corresponding to a first voltage applied to the gate to selectively supply current to the first and second OLEDs, a second transistor for selectively transmitting a data signal to the first electrode of the first transistor by a first scan signal, a third transistor for selectively flowing electric current to the first transistor so that the first transistor serves as a diode by the first scan signal, a capacitor for storing the voltage applied to the gate of the first transistor while a data voltage is applied to the first electrode of the first transistor and for maintaining the stored voltage in the gate of the first transistor in the period where the OLEDs emit light, a fourth transistor for selectively transmitting an initializing signal to the capacitor by a second scan signal, a fifth transistor for selectively transmitting the first power source to the first transistor by the first emission control signal, and a sixth transistor for selectively transmitting the first power source to the first transistor by the second emission control signal.

According to another aspect of the present invention, there is provided a light emitting display including first and second adjacent pixels coupled to one scan line. Each of the first and second pixels includes first and second OLEDs for receiving a current to emit light, a first transistor whose drain is coupled to a first node, whose source is coupled to a second node, and whose gate is coupled to a third node, a second transistor whose source is coupled to a data line, whose drain is coupled to the second node, and whose gate is coupled to a first scan line, a third transistor whose source is coupled to the first node, whose drain is coupled to the third node, and whose gate is coupled to the first scan line, a fourth transistor whose source is coupled to an initializing line, whose drain is coupled to the third node, and whose gate is coupled to a second scan line, a capacitor whose first electrode is coupled to a first power source and whose second electrode is coupled to the third node, a fifth transistor whose source is coupled to the first power supply line, whose drain is coupled to the second node, and whose gate is coupled to a first emission control line, a sixth transistor whose source is coupled to the first power supply line, whose drain is coupled to the second node, and whose gate is coupled to a second emission control line, a seventh transistor whose source is coupled to the first node, whose drain is coupled to the first OLED, and whose gate is coupled to the first emission control line, and an eighth transistor whose source is coupled to the first node, whose drain is coupled to the second OLED, and whose gate is coupled to the second emission control line.

According to another aspect of the present invention, there is provided a light emitting display including first and second adjacent pixels coupled to one scan line. Each of the first and second pixels includes first and second OLEDs for receiving current to emit light, a first transistor whose drain is coupled to a first node, whose source is coupled to a second node, and whose gate is coupled to a third node, a second transistor whose source is coupled to a data line, whose drain is coupled to the second node, and whose gate is coupled to a first scan line, a third transistor whose source is coupled to the second node, whose drain is coupled to the third node, and whose gate is coupled to the first scan line, a fourth transistor whose source is coupled to an initializing line, whose drain is coupled to the third node, and whose gate is coupled to a second scan line, a capacitor whose first electrode is coupled to a first power source and whose second electrode is coupled to the third node, a fifth transistor whose source is coupled to the first power supply line, whose drain is coupled to the second node, and whose gate is coupled to a first emission control line, a sixth transistor whose source is coupled to the first power supply line, whose drain is coupled to the second node, and whose gate is coupled to a second emission control line, a seventh transistor whose source is coupled to the first node, whose drain is coupled to the first OLED, and whose gate is coupled to the first emission control line, and an eighth transistor whose source is coupled to the first node, whose drain is coupled to the second OLED, and whose gate is coupled to the second emission control line.

DETAILED DESCRIPTION

Figure 1:
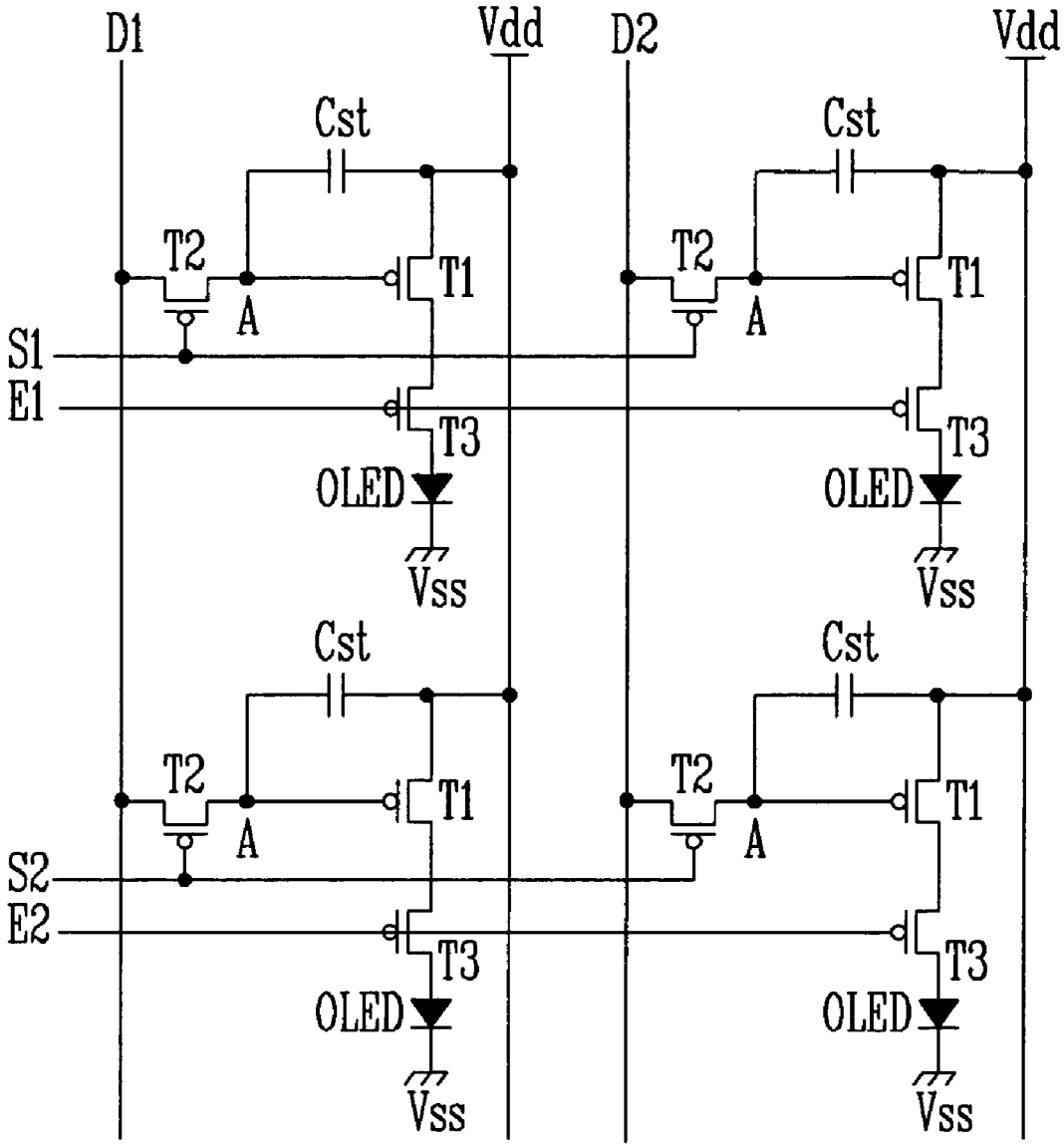
FIG. 1 (PRIOR ART)
FIG. 1 is a circuit diagram illustrating a part of a conventional light emitting display.
Figure 2:
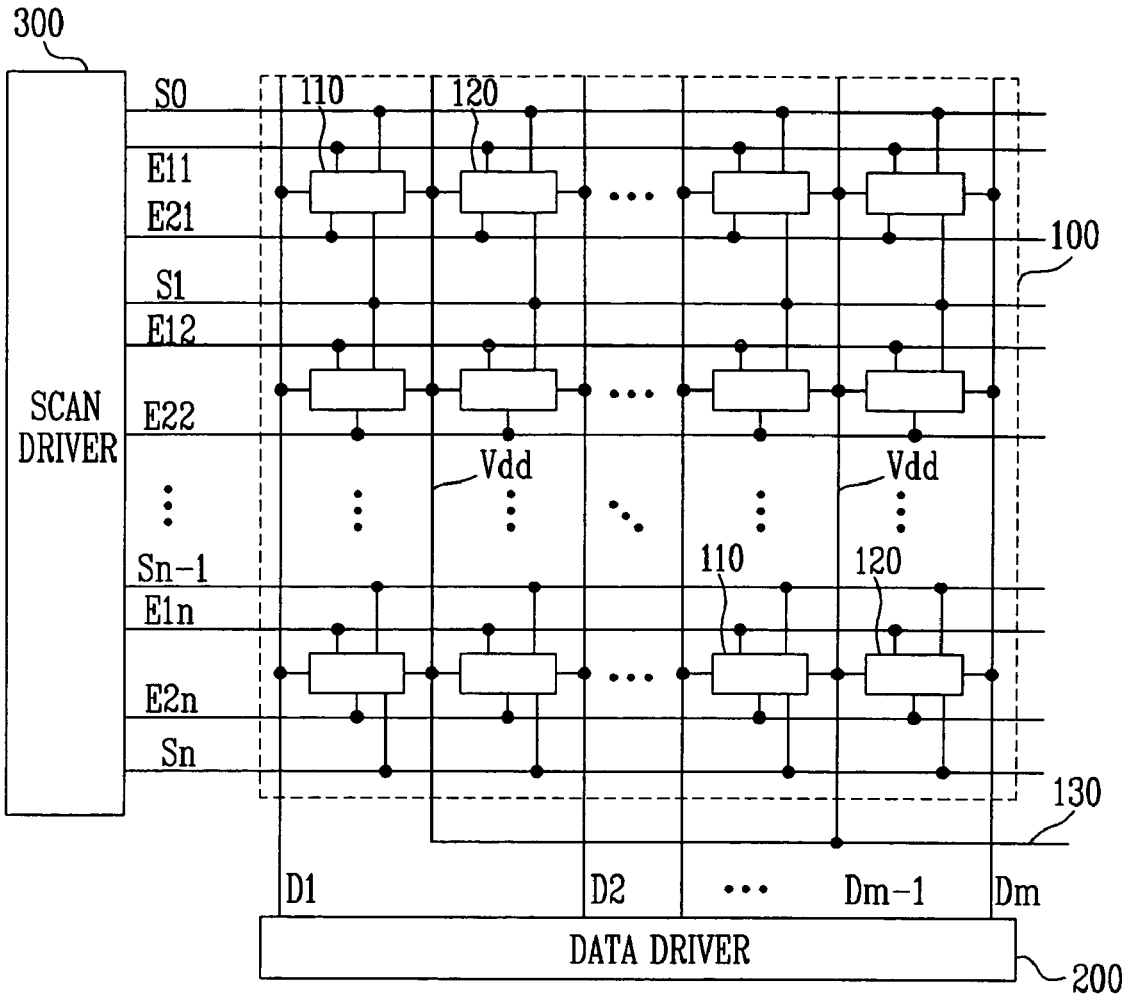
FIG. 2 illustrates the structure of a light emitting display according to a first embodiment of the present invention.

FIG. 2 illustrates a light emitting display according to a first embodiment of the present invention. The light emitting display includes an image display unit 100, a data driver 200, and a scan driver 300.

The image display unit 100 includes a plurality of pixels 110, 120 including a plurality of OLEDs, a plurality of scan lines S0, S1, S2, . . . , Sn−1, Sn arranged in a row direction, a plurality of first emission control lines E11, E12, . . . , E1*n*−1, Em and second emission control lines E21, E22, . . . , E2*n*−1, E2*n* arranged in the row direction, a plurality of data lines D1, D2, . . . , Dm−1, Dm arranged in a column direction, and a plurality of pixel power supply lines Vdd for supplying pixel power.

Each one pixel power supply line Vdd is simultaneously coupled to two adjacent pixels 110 (or to two adjacent pixels 120) in the row direction so that the number of required pixel power supply lines Vdd is reduced to half of the number of pixels. Therefore, it is possible to reduce the number of wiring lines required for the image display unit 100. The pixel power supply lines Vdd receive pixel power source from an external power source 130.

The pixels 110, 120 receive a scan signal of a present or first scan line Sn and a scan signal of a previous or second scan line Sn−1 through the scan lines S0, S1, S2, . . . , Sn−1, Sn and generate driving currents corresponding to data signals by the data signals transmitted from data lines D1, D2, . . . , Dm−1, Dm. The driving currents are transmitted to the OLEDs by first and second emission control signals transmitted through the first emission control lines E11, E12, . . . , E1*n*−1, E1*n* and the second emission control lines E21, E22, . . . , E2*n*−1, E2*n*. Note that the number of scan lines S0 . . . Sn is one more than the number of first or second emission control lines E11 . . . E1*n* or E21 . . . E2*n*.

The data driver 200 is coupled to the data lines D1, D 2, . . . , Dm−1, Dm to transmit the data signals to the image display unit 100. Each one data line sequentially transmits red, green, and blue data.

The scan driver 300, shown in the embodiment of FIG. 2 to be located on the side of the image display unit 100, is coupled to the scan lines S0, S1, S2, . . . , Sn−1, Sn, the first emission control lines E11, E12, . . . , E1*n*−1, E1*n*, and the second emission control lines E21, E22, . . . , E2*n*−1, E2*n* to sequentially transmit the scan signals and the emission control signals to the image display unit 100.

Figure 3:
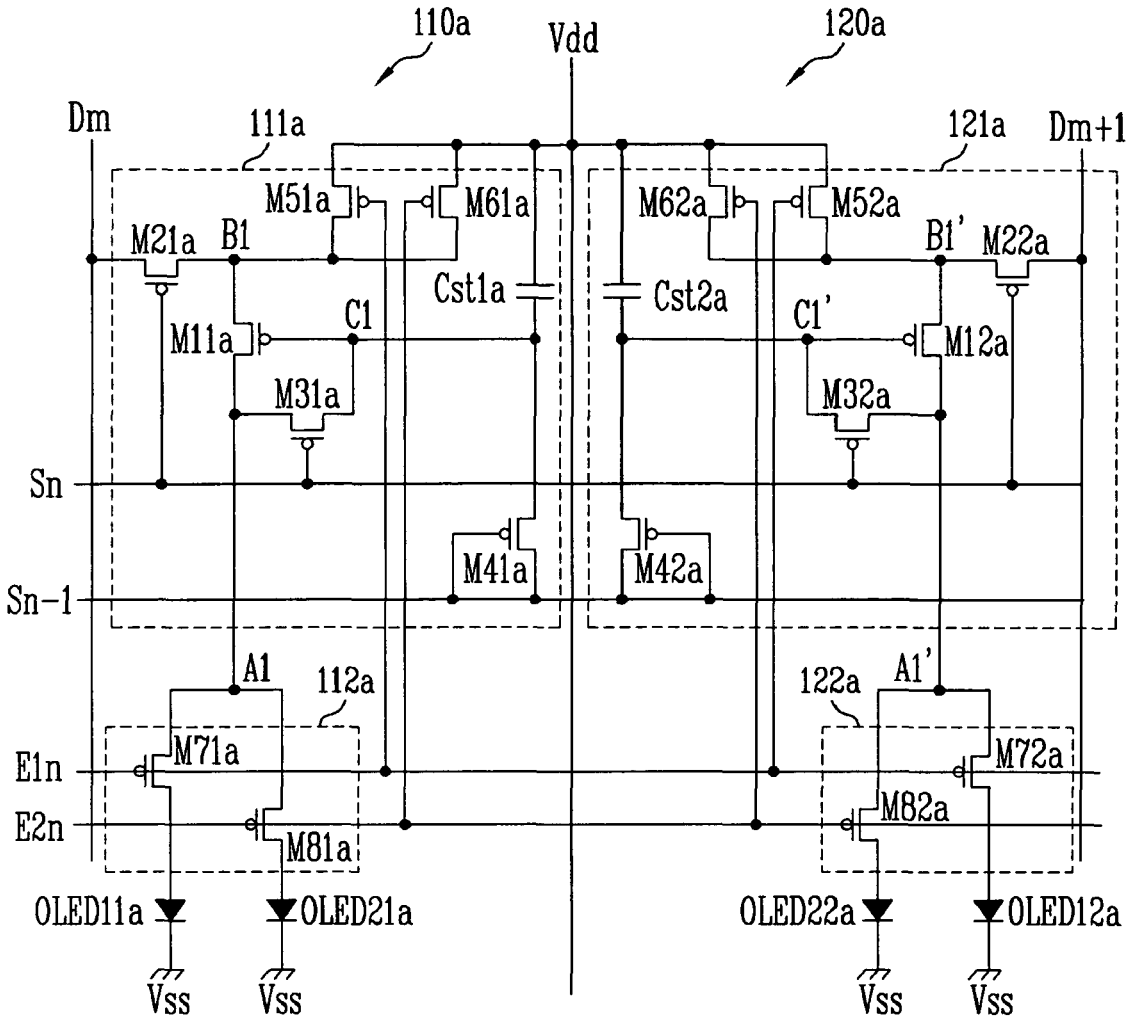
FIG. 3 is a circuit diagram illustrating a first embodiment of the pixel used for the light emitting display of the present invention.

FIG. 3 is a circuit diagram illustrating a first embodiment of the pixel used for the light emitting display of the present invention. The pixels of the first embodiment include two adjacent pixel circuits 110*a*, 120*a* coupled to the same two scan lines Sn, Sn−1. The left pixel is referred to as a first pixel 110*a* and the right pixel is referred to as a second pixel 120*a*.

Each of the first and second pixels 110*a*, 120*a* include a driving circuit and a switching circuit. The driving circuit 111*a*, 121*a* includes elements that are coupled to the scan lines Sn, Sn−1 and are driven by the scan signals sn, sn−1. The switching circuit 112*a*, 122*a* includes switching elements that are coupled to the emission control lines E1*n*, E2*n* and are driven by the emission control signals e1*n*, e2*n*. The switching circuit 112*a*, 122*a* couples the driving circuit 111*a*, 121*a* to the OLEDs and controls the flow of current to these OLEDs.

In the first pixel 110*a*, the drain of the first transistor M11*a* is coupled to a first node A1, the source of the first transistor M11*a* is coupled to a second node B1, and the gate of the first transistor M11*a* is coupled to a third node C1 so that current flows from the second node B1 to the first node A1 in response to the voltage of the third node C1.

The source of the second transistor M21*a* is coupled to the data line Dm, the drain of the second transistor M21*a* is coupled to the second node B1, and the gate of the second transistor M21*a* is coupled to the first scan line Sn. The second transistor M21*a* performs a switching operation by a first scan signal sn transmitted through the first scan line Sn and selectively transmits the data signal transmitted through the data line Dm to the second node B1.

The source of the third transistor M31*a* is coupled to the first node A1, the drain of the third transistor M31*a* is coupled to the third node C1, and the gate of the third transistor M31*a* is coupled to the first scan line Sn. Once the first scan signal sn is transmitted through the first scan line Sn, the potential of the first node A1 is made equal to the potential of the third node C1 and the first transistor M11 becomes coupled like a diode. As a result, electric current flows through the first transistor M11*a*.

The source and gate of the fourth transistor M41*a* are coupled to the second scan line Sn−1 and the drain of the fourth transistor M41*a* is coupled to the third node C1 so that the fourth transistor M41*a* transmits an initializing signal to the third node C1. The initializing signal is the second scan signal sn−1 input to the row that, by one row, precedes the row to which the first scan signal sn is input. The initializing second scan signal sn−1 is transmitted through the second scan line Sn−1. The second scan line Sn−1 is the scan line coupled to the row that, by one row, precedes the row to which the first scan line Sn is coupled.

The source of the fifth transistor M51*a* is coupled to the pixel power supply line Vdd, the drain of the fifth transistor M51*a* is coupled to the second node B1, and the gate of the fifth transistor M51*a* is coupled to the first emission control line E1*n*. The fifth transistor M51*a* selectively transmits the power from the pixel power supply line Vdd to the second node B1 in response to a first emission control signal e1*n* transmitted through the first emission control line E1*n*.

The source of the sixth transistor M61*a* is coupled to the pixel power supply line Vdd, the drain of the sixth transistor M61*a* is coupled to the second node B1, and the gate of the sixth transistor M61*a* is coupled to the second emission control line E2*n* so that the sixth transistor M61*a* selectively transmits the pixel power source to the second node B1 by the second emission control signal e2*n* transmitted through the second emission control line E2*n*.

The source of the seventh transistor M71*a* is coupled to the first node A1, the drain of the seventh transistor M71*a* is coupled to the first OLED OLED11*a*, and the gate of the seventh transistor M71*a* is coupled to the first emission control line E1*n*. In response to the first emission control signal e1*n* transmitted through the first emission control line E1*n*, the seventh transistor M71*a* selectively transmits the current that flows through the first node A1 to the first OLED OLED11*a*, to cause the first OLED OLED11*a* to emit light.

The source of the eighth transistor M81*a* is coupled to the first node A1, the drain of the eighth transistor M81*a* is coupled to the second OLED OLED21*a*, and the gate of the eighth transistor M81*a* is coupled to the second emission control line E2*n*.

In response to the second emission control signal e2*n* transmitted through the second emission control line E2*n*, the eighth transistor M81*a* transmits current that flows through the first node A1 to the second OLED OLED21*a* to emit light from the second OLED OLED21*a*.

The first electrode of the capacitor Cst1*a* is coupled to the pixel power supply line Vdd and the second electrode of the capacitor Cst1*a* is coupled to the third node C1. As a result, the capacitor Cst1*a* is initialized by the initializing signal transmitted to the third node C1 through the fourth transistor M41*a*. Also, the voltage corresponding to the data signal is stored and is transmitted to the third node C1. Therefore, the gate voltage of the first transistor M1*a* is maintained for a predetermined time.

The second pixel 120*a* has the same structure as the first pixel 110*a*. The second pixel 120*a* receives power through the pixel power supply line Vdd to which the first pixel 110*a* is also coupled. The second pixel 120*a* receives a data signal through the second data line Dm+1. The two adjacent pixels 110*a*, 120*a* coupled to one scan line share one pixel power source. So, it is possible to reduce the number of pixel power supply lines Vdd.

Figure 4:
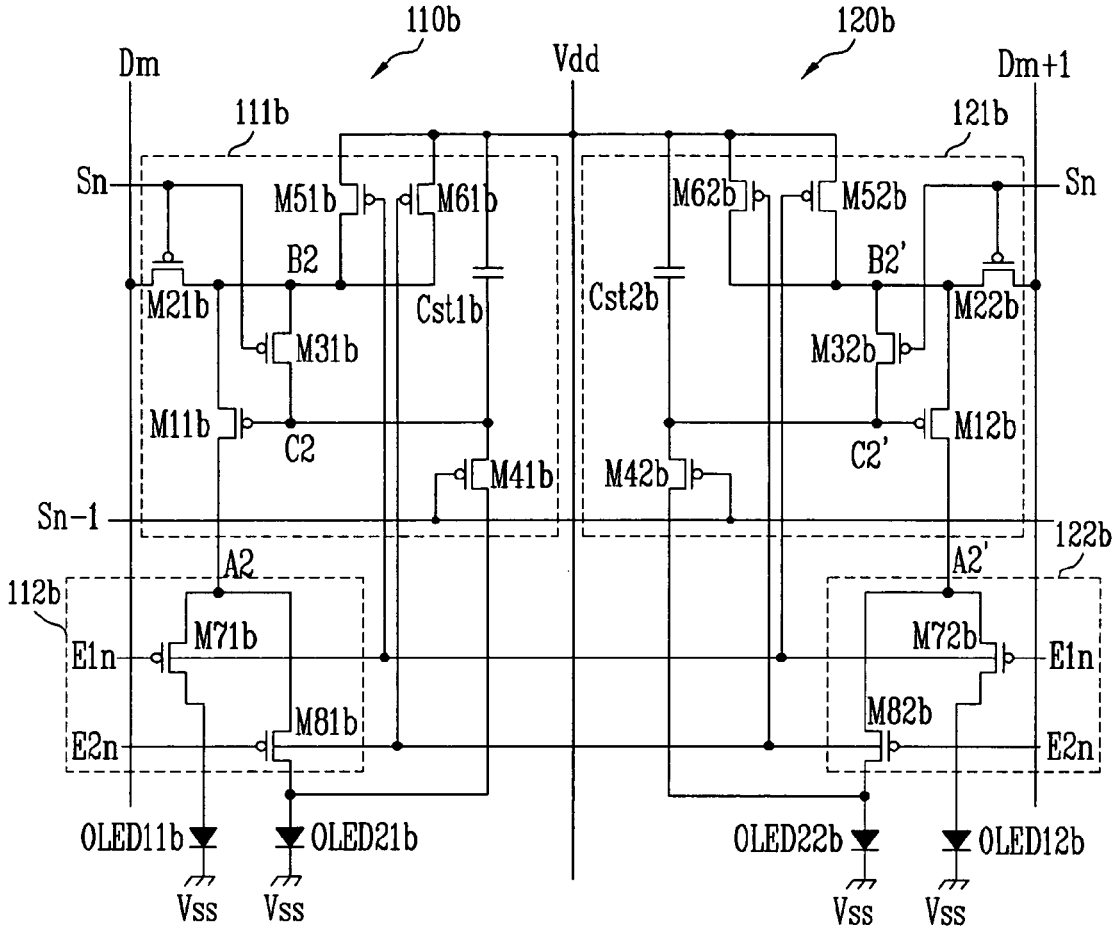
FIG. 4 is a circuit diagram illustrating a second embodiment of the pixel used for the light emitting display of the present invention.

FIG. 4 is a circuit diagram illustrating a second embodiment of the pixel circuit used for the light emitting display of the present invention. The pixels including two adjacent pixel circuits coupled to one scan line are illustrated. In the second pixel circuit, the left pixel is referred to as the first pixel 110*b* and the right pixel is referred to as the second pixel 120*b*.

Each of the first and second pixels 110*b*, 120*b* include a driving circuit and a switching circuit. The driving circuit 111*b*, 121*b* includes elements that are coupled to the scan lines Sn, Sn−1 and are driven by the scan signals sn, sn−1. The switching circuit 112*b*, 122*b* includes switching elements that are coupled to the emission control lines E1*n*, E2*n* and are driven by the emission control signals e1*n*, e2*n*. The switching circuit 112*b*, 122*b* couples the driving circuit 111*b*, 121*b* to the OLEDs and controls the flow of current to these OLEDs.

In the first pixel 110*b*, the drain of the first transistor M1*b* is coupled to a first node A2, the source of the first transistor M1*b* is coupled to a second node B2, and the gate of the first transistor M11*b* is coupled to a third node C2. Current flows from the second node B2 to the first node A2 in response to the voltage of the third node C2.

The source of the second transistor M21*b* is coupled to the data line Dm, the drain of the second transistor M21*b* is coupled to the second node B2, and the gate of the second transistor M21*b* is coupled to the first scan line Sn. The second transistor M21*b* performs a switching operation in response to the first scan signal sn transmitted through the first scan line Sn to selectively transmit the data signal transmitted through the data line Dm to the second node B2.

The source of the third transistor M31*b* is coupled to the second node B2, the drain of the third transistor M31*b* is coupled to the third node C2, and the gate of the third transistor M31*b* is coupled to the first scan line Sn so that the potential of the second node B2 is made equal to the potential of the third node C2 by the first scan signal sn transmitted through the first scan line Sn. Therefore, electric current flows through the first transistor M11*b* diode connecting the first transistor M11*b*.

The source of the fourth transistor M41*b* is coupled to the anode electrode of the OLED21*b*, the gate of the fourth transistor M41*b* is coupled to the second scan line Sn−1, and the drain of the fourth transistor M41*b* is coupled to the third node C2. As a result, the fourth transistor M41*b* transmits an initializing signal to the third node C2. The initializing signal is the voltage applied to the OLED21*b* when no current flows to the OLED21*b*. The voltage applied to the OLED21*b* is transmitted to the third node C2 in response to the second scan signal sn−1 transmitted through the second scan line Sn−1.

The source of the fifth transistor M51*b* is coupled to the pixel power supply line Vdd, the drain of the fifth transistor M51*b* is coupled to the second node B2, and the gate of the fifth transistor M51*b* is coupled to the first emission control line E1*n*. The fifth transistor M51*b* selectively transmits the pixel power source to the second node B2 by the first emission control signal e1*n* transmitted through the first emission control line E1*n*.

The source of the sixth transistor M61*b* is coupled to the pixel power supply line Vdd, the drain of the sixth transistor M61*b* is coupled to the second node B2, and the gate of the sixth transistor M61*b* is coupled to the second emission control line E2*n*. The sixth transistor M61*b* selectively transmits the pixel power source to the second node B2 in response to the second emission control signal e2*n* transmitted through the second emission control line E2*n*.

The source of the seventh transistor M71*b* is coupled to the first node A2, the drain of the seventh transistor M71 is coupled to the first OLED OLED11*b*, and the gate of the seventh transistor M71*b* is coupled to the first emission control line E1*n*. The seventh transistor M71*b* selectively transmits the current that flows through the first node A2 to the first OLED OLED11*b* in response to the first emission control signal e1*n* transmitted through the first emission control signal E1*n* to emit light from the first OLED OLED11*b*.

The source of the eighth transistor M81*b* is coupled to the first node A2, the drain of the eighth transistor M81*b* is coupled to the second OLED OLED21*b*, and the gate of the eighth transistor M81*b* is coupled to the second emission control line E2*n*. The eighth transistor M81*b* transmits current that flows through the first node A to the second OLED OLED21*b* in response to the second emission control signal e2*n* transmitted through the second emission control line E2*n* to emit light from the second OLED OLED21*b*.

The first electrode of the capacitor Cst1*b* is coupled to the pixel power supply line Vdd and the second electrode of the capacitor Cst1*b* is coupled to the third node C2. As a result, the capacitor Cst1*b* is initialized by the initializing signal transmitted to the third node C2 through the fourth transistor M41*b* and the voltage corresponding to the data signal is stored and is transmitted to the third node C2. Therefore, the gate voltage of the first transistor M11*b* is maintained for a predetermined time.

The second pixel 120*b* has the same structure as the first pixel 110*b* and receives power source through the same pixel power supply line to which the first pixel 110*b* is coupled. The second pixel 120*b*, however, receives its data signal through the second data line Dm+1. The two adjacent pixels coupled to one scan line share one pixel power source so that it is possible to reduce the number of pixel power supply lines.

Figure 5:
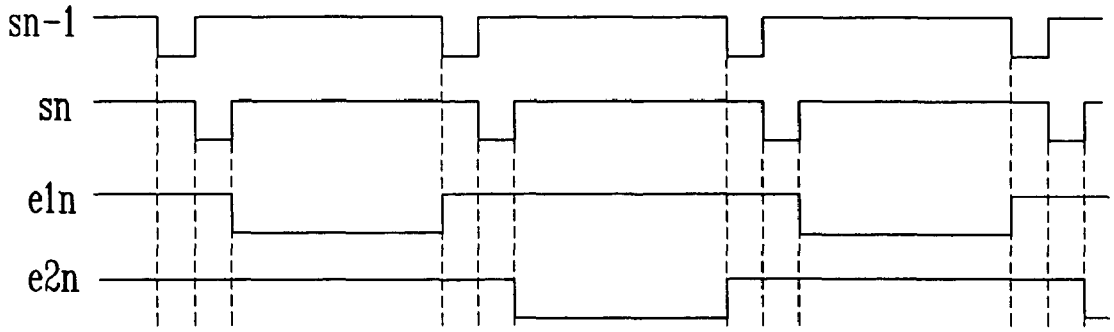
FIG. 5 illustrates waveforms that describe the operation of the pixel of FIGS. 3 and 4.

FIG. 5 illustrates waveforms that describe the operation of the pixel of FIGS. 3 and 4. The first pixel of the first and second embodiments of the pixel circuit 110*a*, 110*b*, 110*c* is operated by the first and second scan signals sn and sn−1 and the first and second emission control signals e1*n* and e2*n*.

First, the fourth transistor M41*a*, M41*b* is turned on by the second scan signal sn−1 allowing the initializing signal to be transmitted to the capacitor Cst1*a*, Cst1*b* and to initialize the capacitor.

The second and third transistors M21*a*, M21*b* and M31*a*, M31*b* are turned on by the first scan signal sn so that the potential of the second node B1, B2 is made equal to the potential of the third node C1, C2. Therefore, electric current flows through the first transistor M11*a*, M11*b* so that the first transistor M11*a*, M11*b* serves as a diode and the data signal is transmitted to the second node B1, B2 through the second transistor M21*a*, M21*b*. The data signal is also transmitted to the second electrode of the capacitor Cst1*a*, Cst1*b* through the second transistor M21*a*, M21*b*, the first transistor M11*a*, M11*b*, and the third transistor M31*a*, M31*b* so that the voltage corresponding to difference between the data signal and the threshold voltage is applied to the second electrode of the capacitor Cst1*a*, Cst1*b*.

After the first scan signal sn transits to the high level, when the first emission control signal e1*n* transits to the low level and is maintained in the low level for a period of time, the fifth and seventh transistors M51*a*, M51*b* and M71*a*, M71*b* are turned on by the first emission control signal e1*n* so that a voltage corresponding to EQUATION 1 is applied between the gate and source of the first transistor M11*a*, M11*b*.

$$Vgs=(Vdata-Vth)-Vdd \quad \text{[EQUATION 1]}$$

where, Vgs, Vdd, Vdata, and Vth represent the voltage between the gate electrode and the source electrode of the first transistor M11*a*, M11*b*, a pixel power source voltage, the voltage of the data signal, and the threshold voltage of the first transistor M11*a*, M11*b*, respectively.

Therefore, the current obtained by EQUATION 2 flows to the first node A1, A2.

[EQUATION 2]

$$\begin{aligned} I &= \frac{\beta}{2}(Vgs-Vth)^2 \\ &= \frac{\beta}{2}(Vdata-Vdd+Vth-Vth)^2 \\ &= \frac{\beta}{2}(Vdata-Vdd)^2 \end{aligned}$$

where, I, Vgs, Vdd, Vth, and Vdata represent the current that flows through the first and second OLEDs, the voltage applied to the gate of the first transistor M11*a*, M11*b*, the voltage of the pixel power source through the power source line, the threshold voltage of the first transistor M11*a*, M11*b*, and the voltage of the data signal, respectively.

EQUATION 2 is independent of Vth. Therefore, the current I flows to the first node A1, A2 regardless of the threshold voltage of the first transistor M11*a*, M11*b*.

Then, the voltage value corresponding to difference between the voltage of the pixel power source through the power source line Vdd and the data signal Vdata is stored in the capacitor Cst1*a*, Cst1*b* by the first and second scan signals sn and sn−1; the voltage Vsg corresponding to EQUATION 1 is transmitted between the source and gate of the first transistor M11*a*, M11*b*, the sixth and eighth transistors M61*a*, M61*b* and M81*a*, M81*b* are turned on by the second emission control signal e2*n*, and the current I corresponding to the EQUATION 2 flows to the second OLED OLED21*a*, OLED21*b*.

Next, the first emission signal e1*n* goes high and the second emission signal e2*n* goes low. Because the first emission control signal e1*n* is in the high level and the second emission control signal e2*n* is in the low level, the seventh transistor M71*a*, M71*b* is turned off and the eighth transistor M81*a*, M81*b* is turned on so that the current flows to the second OLED OLED21*a*, OLED21*b* through the eighth transistor M81*a*, M81*b*.

Therefore, one pixel circuit controls the two OLEDs and the two adjacent pixel circuits coupled to the two OLEDs and the same scan line share one pixel power supply line Vdd to receive the pixel power.

Figure 6:
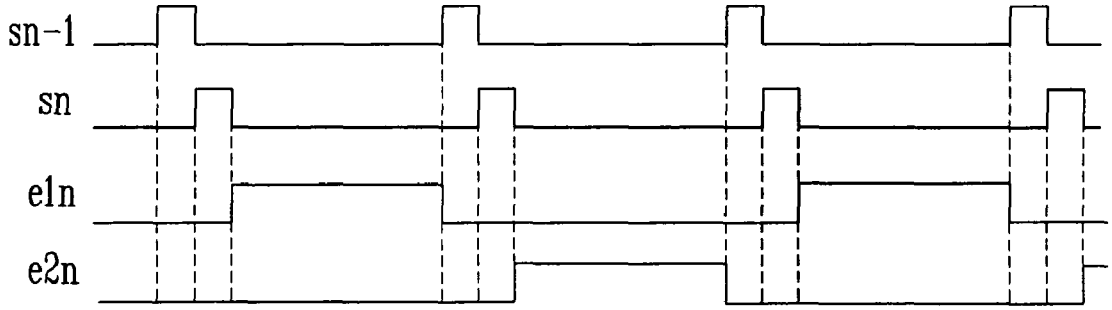
FIG. 6 illustrates waveforms that describe the operation of the pixel of FIGS. 3 and 4 using NMOS transistors.

In the pixel circuits of FIGS. 3 and 4, the first to eighth transistors M11*a*, M11*b* to M81*a*, M81*b* are formed of the PMOS transistors. However, when the first to eighth transistors M11*a*, M11*b* to M81*a*, M81*b* are formed of the NMOS transistors, the pixel circuit operates using the waveforms illustrated in FIG. 6. Note that PMOS transistors are turned on when the voltage at their gate electrode is lower than the voltage at the source electrode while NMOS transistors are turned on when the voltage at their gate electrode is higher than the voltage at their source electrode. The difference between the gate and source voltages in both cases must be above a threshold voltage of the transistor.

Figure 7:
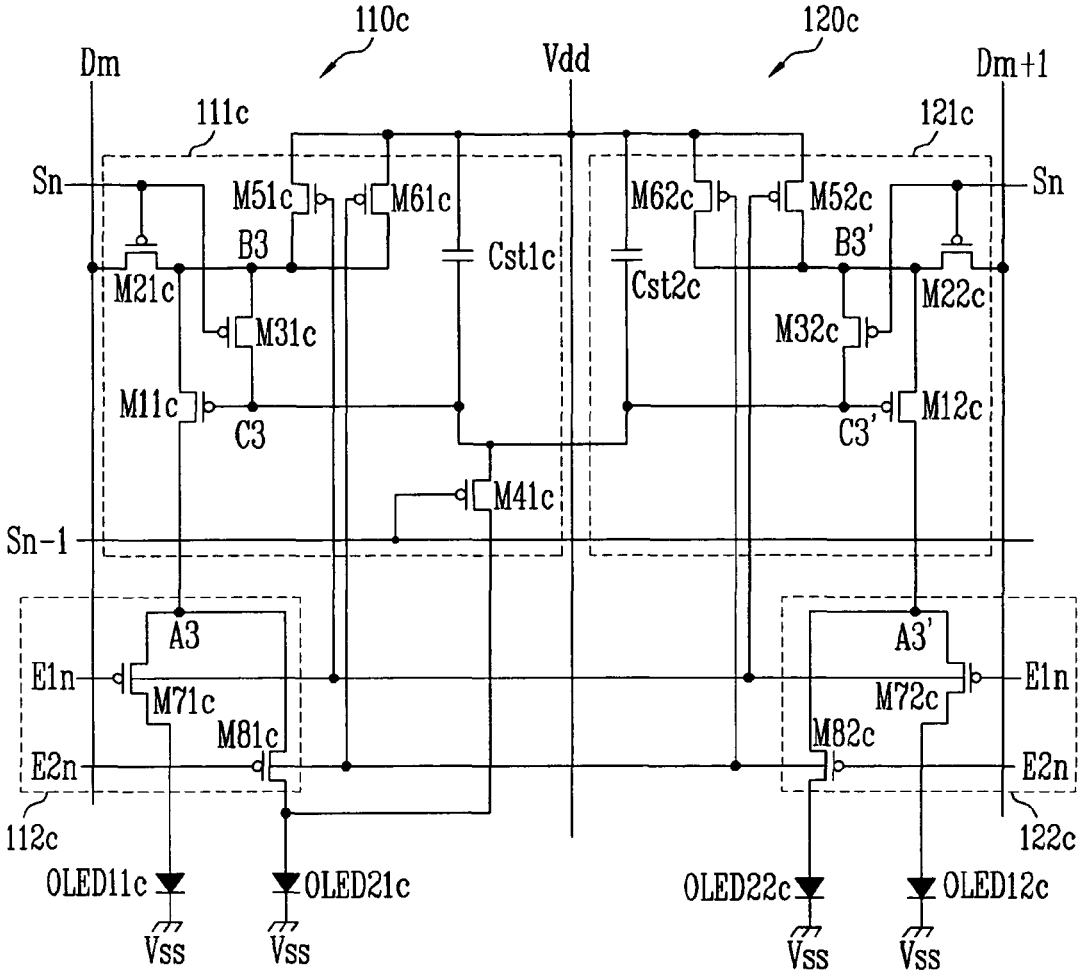
FIG. 7 is a circuit diagram illustrating a third embodiment of the pixel used for the light emitting display of the present invention.

FIG. 7 is a circuit diagram illustrating a third embodiment of the pixel circuit used for the light emitting display of the present invention. The third pixel circuit includes two adjacent pixel circuits 110*c*, 120*c* coupled to one scan line. The left pixel is referred to as the first pixel 110*c* and the right pixel is referred to as the second pixel 120*c*.

Each of the first and second pixels 110*c*, 120*c* include a driving circuit and a switching circuit. The driving circuit 111*c*, 121*c* includes elements that are coupled to the scan lines Sn, Sn−1 and are driven by the scan signals sn, sn−1. The switching circuit 112*c*, 122*c* includes switching elements that are coupled to the emission control lines E1*n*, E2*n* and are driven by the emission control signals e1*n*, e2*n*. The switching circuit 112*c*, 122*c* couples the driving circuit 111*c*, 121*c* to the OLEDs and controls the flow of current to these OLEDs.

The first and second pixels 110*c*, 120*c* share the fourth transistor M41*c* that transmits the initializing signal. Using one initializing transistor decreases the circuit area and increases the aperture ratios of the first and second pixels 110*c*, 120*c*.

The source of the fourth transistor M41*c* is coupled to the second OLEDs OLED21*c*, OLED22*c* in the first and second pixels 110*c*, 120*c*, the drain of the fourth transistor M41*c* is commonly coupled to the capacitor Cst1*c* of the first pixel 110*c* and the capacitor Cst2*c* of the second pixel 120*c*, and the gate of the fourth transistor M41*c* is coupled to the second scan line Sn−1 so that the fourth transistor M41*c* transmits the initializing signal in response to the second scan signal sn−1. Therefore, the first and second pixels 110*c*, 120*c* are simultaneously initialized.

In the exemplary depiction of the third embodiment shown in FIG. 7, the driving circuits 111*c*, 121*c* of the first and second pixel circuits 110*c*, 120*c* are similar to the driving circuits 111*a*, 121*a* of the first and second pixel circuits 110*a*, 120*a* of the first embodiment. However, the driving circuits of the second embodiment 111*b*, 121*b* could be used in another example of the third embodiment. As FIGS. 3 and 4 indicate, one of the differences between the first and second embodiments 110*a*, 110*b* lies in the location of their respective third transistors M31*a*, M31*b*. Either circuit may be used in the third embodiment, as longs as a common fourth transistor M41*c* is also used.

Further, in the exemplary embodiments of the first, second, and third pixel circuit shown in FIGS. 3, 4, and 7, only two emission control lines and two OLEDs are shown per pixel circuit. A plurality of OLEDs may be driven by the driving circuit of each pixel circuit, if an appropriate switching circuit is included and appropriate emission signals are provided.

As described above, according to the pixel circuit and the light emitting display of the present invention, the two adjacent pixel circuits coupled to one scan line share one pixel power supply line Vdd and a number of OLEDs are coupled to every one pixel circuit. Therefore, it is possible to reduce the number of pixel circuits. It is also possible to reduce the number of wiring lines of the light emitting display. Reducing the number of the pixel circuits and the number of wiring lines both allow an increase in the aperture ratio.

Although exemplary embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A light emitting display comprising:

an image display unit coupled to a plurality of scan lines, a plurality of data lines, a plurality of emission control lines, and a plurality of first power supply lines, the image display unit comprising a plurality of pixels in regions defined by the scan lines and the data lines, wherein two adjacent pixels among the plurality of pixels are coupled to one of the scan lines and one of the first power supply lines between the two adjacent pixels, and each of the two adjacent pixels comprises:

a first organic light emitting diode and a second organic light emitting diode;

a driving circuit for driving the first organic light emitting diode and the second organic light emitting diode; and a switching circuit coupled between the driving circuit and the first organic light emitting diode and the second organic light emitting diode for sequentially controlling the driving of the first organic light emitting diode and the second organic light emitting diode, wherein the driving circuit comprises:

a first transistor for selectively supplying a current to the first organic light emitting diode or the second organic light emitting diode in response to receiving a first voltage from the one of the first power supply lines at its gate electrode;

a second transistor for selectively transmitting a data signal to a first electrode of the first transistor in response to a first scan signal;

a third transistor for selectively diode-coupling the first transistor in response to the first scan signal;

a capacitor for storing the first voltage applied to the gate electrode of the first transistor while a data voltage is applied to the first electrode of the first transistor, and for maintaining the voltage at the gate electrode of the first transistor at the first voltage during a period when the first organic light emitting diode or the second organic light emitting diode emits light;

a fourth transistor for selectively transmitting an initializing signal to the capacitor in response to a second scan signal;

a fifth transistor for selectively transmitting power from the one of the first power supply lines to the first transistor in response to a first emission control signal; and a sixth transistor for selectively transmitting power from the one of the first power supply lines to the first transistor in response to a second emission control signal, wherein a total number of the first power supply lines in the light emitting display is about half a total number of the data lines in the light emitting display, and wherein the switching circuit comprises:

a seventh transistor for transmitting the current to the first organic light emitting diode in response to the first emission control signal; and an eighth transistor for transmitting the current to the second organic light emitting diode in response to the second emission control signal.

2. The light emitting display of claim 1, wherein the two adjacent pixels are coupled to different data lines of the plurality of data lines.

3. The light emitting display of claim 1, wherein the two adjacent pixels share the same fourth transistor.

4. The light emitting display of claim 1, wherein the second scan signal is transmitted to one of the scan lines that precedes another one of the scan lines by one row to which the first scan signal is transmitted.

5. The light emitting display of claim 1, wherein the initializing signal is the second scan signal.

6. The light emitting display of claim 1, wherein the initializing signal is a voltage applied to one of the first organic light emitting diode or the second organic light emitting diode when the current is not supplied by the first transistor.

7. A light emitting display having two adjacent pixels coupled to one scan line, each of the two adjacent pixels comprising:

a first organic light emitting diode and a second organic light emitting diode for receiving a current to emit light;

a first transistor having a first drain coupled to a first node, a first source coupled to a second node, and a first gate coupled to a third node;

a second transistor having a second source coupled to a data line, a second drain coupled to the second node, and a second gate coupled to a first scan line;

a third transistor having a third source coupled to the first node, a third drain coupled to the third node, and a third gate coupled to the first scan line;

a fourth transistor having a fourth source coupled to an initializing line, a fourth drain coupled to the third node, and a fourth gate coupled to a second scan line;

a capacitor having a first electrode coupled to a first power supply line and a second electrode coupled to the third node;

a fifth transistor having a fifth source coupled to the first power supply line, a fifth drain coupled to the second node, and a fifth gate coupled to a first emission control line;

a sixth transistor having a sixth source coupled to the first power supply line, a sixth drain coupled to the second node, and a sixth gate coupled to a second emission control line;

a seventh transistor having a seventh source coupled to the first node, a seventh drain coupled to the first organic light emitting diode, and a seventh gate coupled to the first emission control line; and an eighth transistor having an eighth source coupled to the first node, an eighth drain coupled to an anode of the second organic light emitting diode, and an eighth gate coupled to the second emission control line, wherein the two adjacent pixels share the same first power supply line between the two adjacent pixels, and wherein a total number of power supply lines in the light emitting display is about half a total number of data lines in the light emitting display.

8. The light emitting display of claim 7, wherein the initializing line is the second scan line.

9. The light emitting display of claim 7, wherein the two adjacent pixels share the same fourth transistor.

10. A light emitting display having two adjacent pixels coupled to one scan line, each of the two adjacent pixels comprising:

a first organic light emitting diode and a second organic light emitting diode for receiving a current to emit light;

a first transistor having a first drain coupled to a first node, a first source coupled to a second node, and a first gate coupled to a third node;

a second transistor having a second source coupled to a data line, a second drain coupled to the second node, and a second gate coupled to a first scan line;

a third transistor having a third source coupled to the first node, a third drain coupled to the third node, and a third gate coupled to the first scan line;

a fourth transistor having a fourth source coupled to an anode of the second organic light emitting diode, a fourth drain coupled to the third node, and a fourth gate coupled to a second scan line;

a capacitor having a first electrode coupled to a first power supply line and a second electrode coupled to the third node;

a fifth transistor having a fifth source coupled to the first power supply line, a fifth drain coupled to the second node, and a fifth gate coupled to a first emission control line;

a sixth transistor having a sixth source coupled to the first power supply line, a sixth drain coupled to the second node, and a sixth gate coupled to a second emission control line;

a seventh transistor having a seventh source coupled to the first node, a seventh drain coupled to the first organic light emitting diode, and a seventh gate coupled to the first emission control line; and an eighth transistor having an eighth source coupled to the first node, an eighth drain coupled to the anode of the second organic light emitting diode, and an eighth gate coupled to the second emission control line, wherein the two adjacent pixels share the same first power supply line between the two adjacent pixels, and wherein a total number of power supply lines in the light emitting display is about half a total number of data lines in the light emitting display.

11. The light emitting display of claim 10, wherein the two adjacent pixels share the same fourth transistor.

12. The light emitting display of claim 10, wherein an initializing signal is a voltage applied to one of the first organic light emitting diode or the second organic light emitting diode when the first transistor is not applying the current.

13. A method for driving the light emitting display of claim 10, the method comprising:

applying a second scan signal on the second scan line;

applying a first scan signal on the first scan line after the second scan signal;

applying a first emission control signal on the first emission control line after the first scan signal;

applying another second scan signal on the second scan line after the first emission control signal;

applying another first scan signal on the first scan line after the another second scan signal; and applying a second emission control signal on the second emission control line after the another first scan signal, wherein the first scan signal, the another first scan signal, the second scan signal, the another second scan signal, the first emission control signal, and the second emission control signal are adapted to turn on a transistor having a gate receiving the respective signals.

14. A light emitting display having two adjacent pixels coupled to one scan line, each of the two adjacent pixels comprising:

a first organic light emitting diode and a second organic light emitting diode for receiving a current to emit light;

a first transistor having a first drain coupled to a first node, a first source coupled to a second node, and a first gate coupled to a third node;

a second transistor having a second source coupled to a data line, a second drain coupled to the second node, and a second gate coupled to a first scan line;

a third transistor having a third source coupled to the second node, a third drain coupled to the third node, and a third gate coupled to the first scan line;

a fourth transistor having a fourth source coupled to an anode of the second organic light emitting diode, a fourth drain coupled to the third node, and a fourth gate coupled to a second scan line;

a capacitor having a first electrode coupled to a first power supply line and a second electrode coupled to the third node;

a fifth transistor having a fifth source coupled to the first power supply line, a fifth drain coupled to the second node, and a fifth gate coupled to a first emission control line;

a sixth transistor having a sixth source coupled to the first power supply line, a sixth drain coupled to the second node, and a sixth gate coupled to a second emission control line;

a seventh transistor having a seventh source coupled to the first node, a seventh drain coupled to the first organic light emitting diode, and a seventh gate coupled to the first emission control line; and an eighth transistor having an eighth source coupled to the first node, an eighth drain coupled to the anode of the second organic light emitting diode, and an eighth gate coupled to the second emission control line, wherein the two adjacent pixels share the same first power supply line between the two adjacent pixels, and wherein a total number of power supply lines in the light emitting display is about half a total number of data lines in the light emitting display.

15. A method for driving a light emitting display, the light emitting display having an image display unit coupled to a plurality of scan lines, a plurality of data lines, a plurality of emission control lines, and a plurality of first power supply lines, the image display unit having a plurality of pixels in regions defined by the scan lines and the data lines, two adjacent pixels of the plurality of pixels coupled to one of the scan lines and one of the first power supply lines between the two adjacent pixels, each of the two adjacent pixels having a plurality of organic light emitting diodes comprising a first organic light emitting diode and a second organic light emitting diode, wherein a total number of the first power supply lines in the light emitting display is about half a total number of the data lines in the light emitting display, and wherein the first and second organic light emitting diodes are coupled to first and second transistors, respectively, the method comprising:

receiving a first voltage from the one of the first power supply lines to turn on a first switch to selectively supply a current to the plurality of organic light emitting diodes;

selectively transmitting a data signal to the first switch in response to a first scan signal turning on a second switch;

storing the first voltage in a capacitor coupled to the first switch while a data voltage is being transmitted through the first switch;

applying the stored first voltage to the first switch to keep the first switch on to transmit the data voltage while at least one of the plurality of organic light emitting diodes emits light;

selectively initializing the capacitor in response to a second scan signal;

selectively transmitting power from the one of the first power supply lines to maintain the first switch on; and sequentially controlling driving of the plurality of organic light emitting diodes, comprising:

driving the first organic light emitting diode by the first transistor in response to a first emission control signal; and driving the second organic light emitting diode by the second transistor in response to a second emission control signal.

16. The method of claim 15, wherein the two adjacent pixels receive the first voltage from the same one of the first power supply lines between the two adjacent pixels.

* * * * *